US006979149B1

(12) United States Patent
Thompson

(10) Patent No.: US 6,979,149 B1
(45) Date of Patent: Dec. 27, 2005

(54) VESSEL TRANSFER SYSTEM AND ASSOCIATED METHODS

(76) Inventor: Kenneth R. Thompson, 250 W. 8th St., Chuluota, FL (US) 32766

( * ) Notice: Subject to any disclaimer, the term of this patent is extended or adjusted under 35 U.S.C. 154(b) by 0 days.

(21) Appl. No.: 10/869,424

(22) Filed: Jun. 16, 2004

(51) Int. Cl.[7] ..... E02C 5/00
(52) U.S. Cl. ..... 405/86; 405/85; 405/3
(58) Field of Search ..... 405/1, 3, 4, 6, 405/86, 85, 84

(56) References Cited

U.S. PATENT DOCUMENTS

| | | | | | |
|---|---|---|---|---|---|
| 423,561 | A | * | 3/1890 | Jebens | 405/86 |
| 513,800 | A | * | 1/1894 | Lubowski | 405/86 |
| 561,902 | A | | 6/1896 | Lubowski | |
| 619,043 | A | | 2/1899 | Hoech | |
| 704,611 | A | | 7/1902 | Brown | |
| 758,857 | A | | 5/1904 | Saner | |
| 802,576 | A | | 10/1905 | Lohle et al. | |
| 850,320 | A | * | 4/1907 | Roeder | 405/86 |
| 1,086,529 | A | * | 2/1914 | Harris | 405/86 |
| 3,390,530 | A | | 7/1968 | Toben | 114/45 |
| 3,398,540 | A | * | 8/1968 | Toben | 405/86 |
| 3,656,305 | A | * | 4/1972 | Aubert | 405/86 |
| 3,683,629 | A | * | 8/1972 | Paull et al. | 405/85 |
| 3,686,871 | A | * | 8/1972 | Scholler et al. | 405/86 |
| 4,275,973 | A | * | 6/1981 | Aubert | 405/86 |
| 4,763,592 | A | | 8/1988 | Russ | 114/45 |
| 4,877,351 | A | | 10/1989 | Enami | 405/86 |
| 5,947,639 | A | | 9/1999 | Bishop et al. | 405/3 |
| 6,174,106 | B1 | | 1/2001 | Bishop et al. | 405/3 |
| 6,457,904 | B2 | | 10/2002 | Bishop et al. | 405/3 |
| 2001/0006590 | A1 | | 7/2001 | Bishop et al. | 405/3 |

* cited by examiner

*Primary Examiner*—Frederick L. Lagman
(74) *Attorney, Agent, or Firm*—The Torpy Group, P.L.C.

(57) ABSTRACT

A system for transferring a vessel between a first body of water having a first water level and a second body of water having a second water level includes a barrier separating the first body of water from the second body of water. The system also includes a transfer structure adjacent the barrier for receiving the vessel to be transferred between the first and second bodies of water, and a transfer apparatus adjacent the barrier for moving the transfer structure between a first position and a second position. The upper portion of the barrier includes a barrier door that is movable between an opened position when the transfer structure is in the second position to allow the vessel to move into and out of the transfer structure, and a closed position when the transfer structure is in the first position.

31 Claims, 8 Drawing Sheets

VESSEL TRANSFER SYSTEM AND ASSOCIATED METHODS

FIELD OF THE INVENTION

The present invention relates to the field of transferring vessels, and, more particularly, to the field of transferring vessels between a navigable waterway, and a private waterway, and related methods.

BACKGROUND OF THE INVENTION

Boating communities may sometimes have marina pools so that residents may keep their vessels in the water. These marina pools are generally constructed adjacent a navigable waterway. Further, a barrier generally separates the marina pool from the adjacent navigable waterway. There are many advantages to marina pools, such as a more protected environment for keeping a vessel in water, for example.

One disadvantage that exists with boating communities that have such marina pools, however, is that in order for the vessel to be used in the adjacent navigable waterway, it must first be transferred from the marina pool to the navigable waterway. More particularly, the marina pool may have a first water level, and the navigable waterway may have a second water level.

U.S. Pat. No. 5,947,639 to Bishop et al. discloses a boat lift apparatus for lifting a boat out of water to thereafter transfer the boat over a barrier that separates a first body of water from a second body of water. The boat lift apparatus includes a carriage connected to a pair of opposing horizontal supports. The carriage includes a plurality of slings that extend downwardly, and that may be moved between a lowered position and an elevated position. When in the lowered position, the slings may engage the hull of the boat so that when the slings are elevated, the boat is lifted out of the water. When the boat is lifted out of the water, the carriage may be moved in a horizontal direction to thereby transfer the boat over the barrier.

U.S. Pat. No. 6,457,904 also to Bishop et al. discloses a boat lift apparatus including a vertically movable lift frame support bed which rolls on tracks that are positioned adjacent a barrier separating a first body of water from a second body of water. Both of the Bishop et al. patents require that the vessel be raised completely out of the water.

U.S. Pat. No. 423,561 to Jebens discloses a floating lock for use in canals to move a vessel from one water level to another. The floating lock includes a tank that is movable between elevated and lowered positions. The floating lock also includes a watertight drum positioned in a well, and a cylinder for lifting the tank connected to the watertight drum. As the tank is lowered, the cylinder fills with water, and as the tank is raised, water in the cylinder drains into the well. Displacement of the watertight drum is overcome by the weight in the cylinder to lower the tank. This system, however, may be quite expensive and complicated to install, as well as time consuming to construct. Further, using such a system to transfer a vessel from one water level to another may be very slow.

U.S. Pat. No. 802,576 to Lohle et al. discloses a boat lift apparatus including a tank having a rotating carriage that engages a large screw-thread to move the tank between elevated and lowered positions. The tank is suspended from vertical posts that extend above the sidewalls of the tank, out of the water. Again, this system may be very expensive, complicated, and time consuming to install, and may also be slow to transfer a vessel between two bodies of water.

SUMMARY OF THE INVENTION

In view of the foregoing background, it is therefore an object of the present invention to provide a practical energy efficient, and time efficient system for transferring a vessel between a first body of water and second body of water separated by a barrier that may be readily installed adjacent an existing barrier. It is further an object of the present invention to provide a system for transferring a vessel between a first body of water and second body of water without lifting the vessel out of the water. It is still another object of the present invention to provide a system for transferring a vessel between a first and second body of water that is secure.

These and other objects, features, and advantages in accordance with the present invention are provided by a system comprising a transfer structure adjacent the first side of the barrier for receiving the vessel to be transferred between the first and second bodies of water. The system may also comprise a transfer apparatus adjacent the barrier for moving the transfer structure between a first position and a second position.

The transfer apparatus may comprise at least one motor, at least one cable engagement rod connected to the at least one motor, and at least one cable connected between the at least one cable engagement rod and the transfer structure. The upper portion of the barrier may include a barrier door that is movable between an opened position when the transfer structure is in the second position to thereby allow the vessel to move into and out of the transfer structure, and a closed position when the transfer structure is in the first position. The barrier door may be a hinged barrier door, or a sliding barrier door, for example.

The system may also include a counterweight apparatus. The counterweight apparatus may comprise at least one variable engagement member in communication with the at least one cable engagement rod, at least one weight, and a length of cable connected between the weight, the at least one variable engagement member, and the cable engagement rod. Accordingly, the transfer structure may advantageously be moved between the first and second positions in a time efficient and energy efficient manner.

The system may also comprise a tide control apparatus. The tide control apparatus may include a controller, and a tide control sensor in communication with the controller. The tide control apparatus may also comprise at least one tide control weight, a tide control cable engagement rod, and a length of cable connecting the tide control weight to the tide control cable engagement rod.

The transfer structure may have an exit adjacent the barrier, and an entry opposite the exit. Further, the transfer structure may comprise a bottom surface, a pair of opposing sidewalls extending upwardly from the bottom surface, and an end wall adjacent the entry. Accordingly, the vessel may advantageously be transferred between the first and second bodies of water without lifting the vessel out of the water.

The end wall may include an end wall door that is moveable between an opened position and a closed position. The end wall door may be a hinged end wall door, or a sliding end wall door, for example.

The first position of the transfer structure may be a lowered position, and the second position of the transfer structure may be an elevated position. Further, the first water level may be lower than the second water level. The system may also include vessel guides extending upwardly from the transfer structure so that when the transfer structure is submerged, the boundaries of the transfer structure may advantageously be located without the need to visualize the transfer structure.

A method aspect of the present invention is for transferring the vessel between a first body of water and a second body of water separated by a barrier. The method may comprise submerging the transfer structure in the first body of water adjacent the barrier, positioning the vessel to overlie the submerged transfer structure, moving the transfer structure from a first position to a second position, and moving a barrier door on an upper portion of the barrier from a closed position to an opened position when the transfer structure is in the elevated position to allow the vessel to move to the second body of water.

DETAILED DESCRIPTION OF THE PREFERRED EMBODIMENTS

Figure 1:
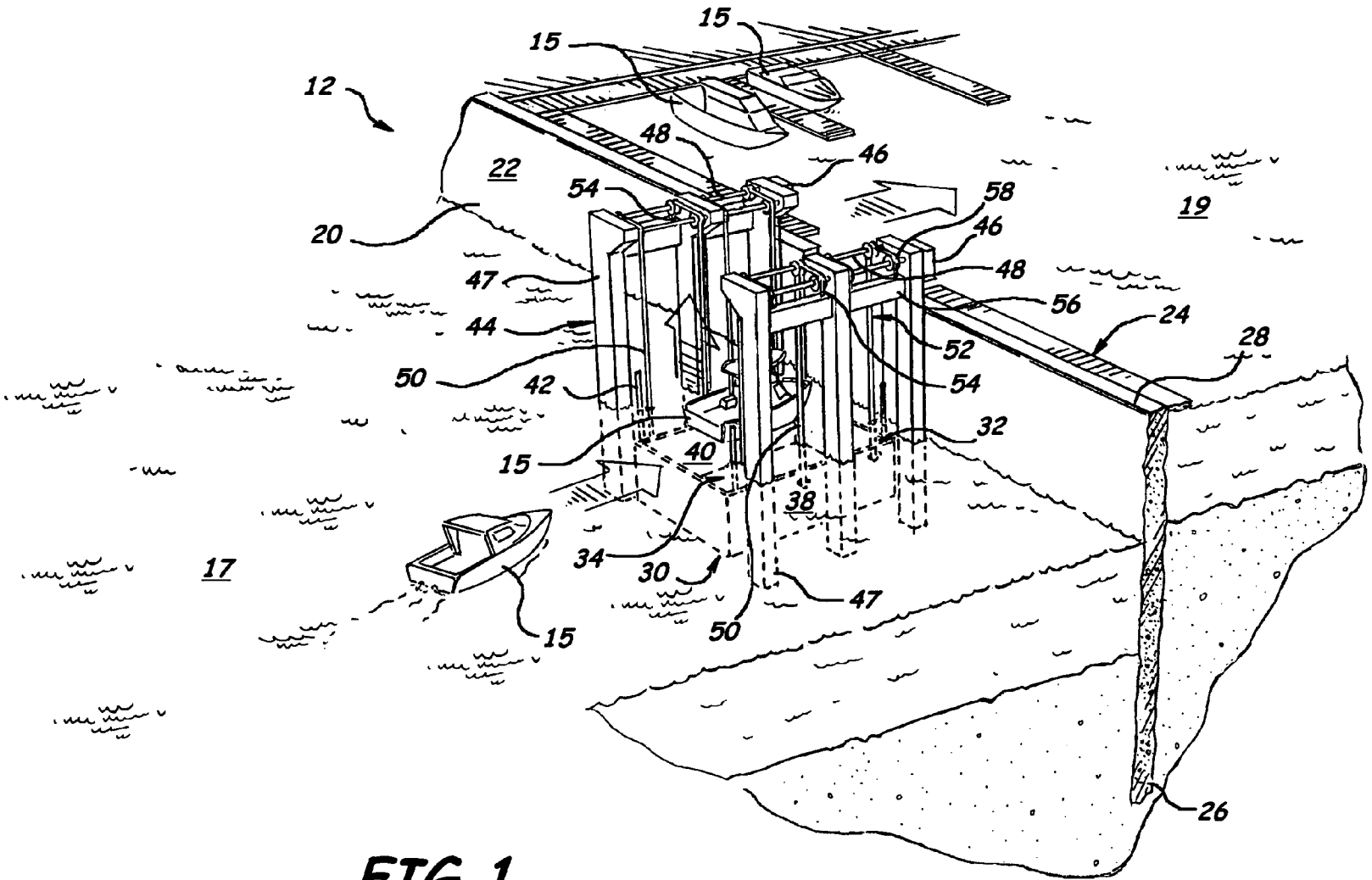
FIG. 1 is a partial environmental view of a system for transferring a vessel from a first body of water to a second body of water according to the present invention.
Figure 2:
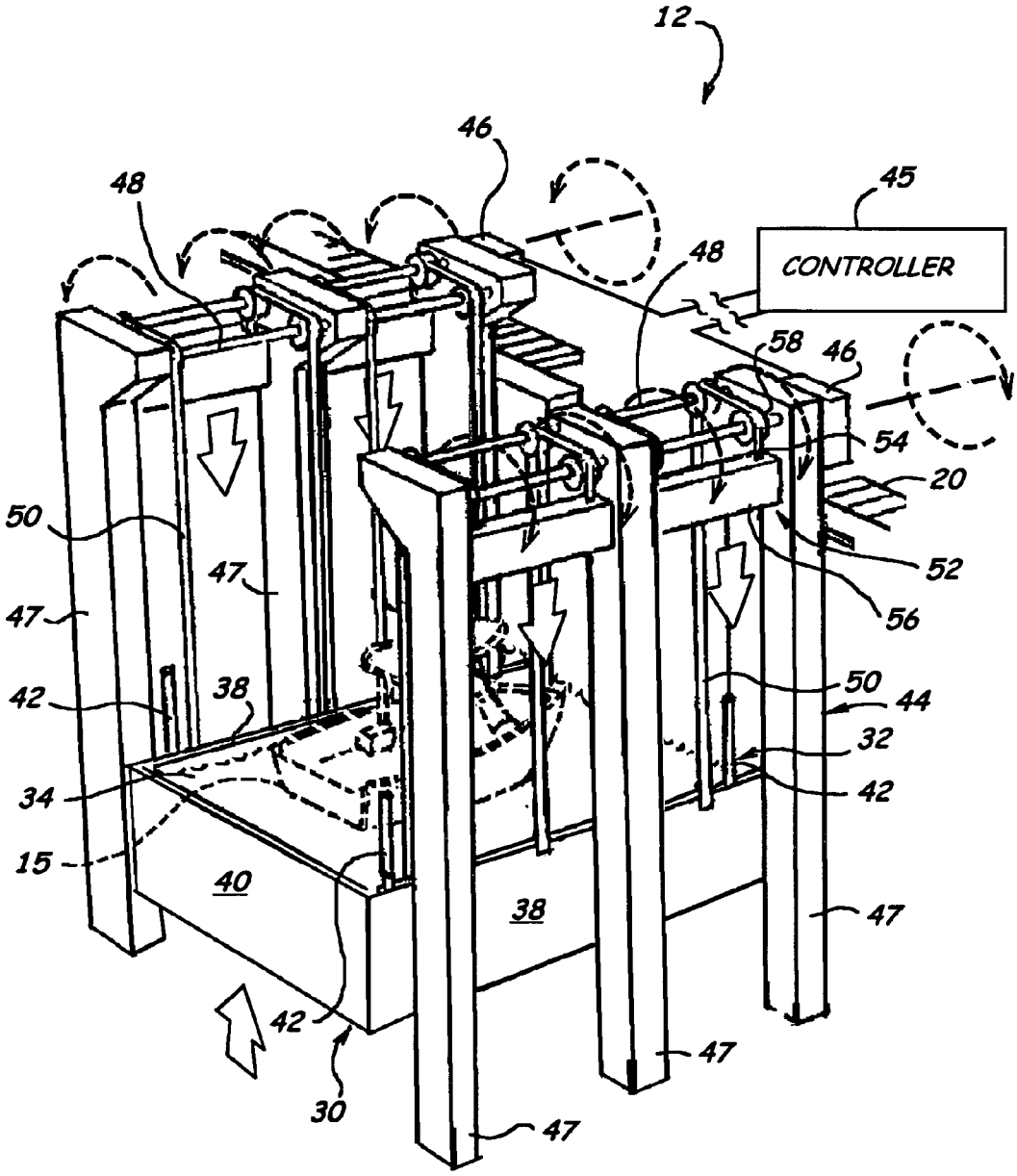
FIG. 2 is a perspective view of a transfer structure and transfer apparatus of the system illustrated in FIG. 1.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and multiple prime notations are used to indicate similar elements in alternate embodiments.

Referring initially to FIGS. 1–4C, a system 12 for transferring a vessel 15 between a first body of water 17 and a second body of water 19 is now described. The first body of water 17 may, for example, be a navigable waterway, and the second body of water 19 may be a waterway adjacent the navigable waterway, such as a marina pool for a boating community, for example, or any other waterway that is adjacent to, and separated from, a navigable waterway, as understood by those skilled in the art.

The first body of water 17 has a first water level, and the second body of water 19 has a second water level. In the illustrated embodiments, the first water level is lower than the second water level. Those skilled in the art, however, will appreciate that the second water level may, in the alternative, be lower than the first water level.

A barrier 20 illustratively separates the first body of water 17 from the second body of water 19. The barrier 20 may be a concrete barrier, such as a seawall, for example, or any other type of barrier suitable for separating the first body of water 17 from the second body of water 19. The barrier 20 has a first side 22 adjacent the first body of water 17, and a second side 24 adjacent the second body of water 19.

The barrier 20 has a lower portion 26 and an upper portion 28. The upper portion 28 of the barrier 20 is preferably positioned above the higher of the first and second water levels, and lower portion 26 of the barrier is preferably positioned below the lower of the first and second water levels. More specifically, the lower portion 26 may rest on a bottom surface between the first and second bodies of water 17, 19, i.e., on the navigable waterway floor.

The transfer structure 30 illustratively includes a bottom surface 36, a pair of opposing sidewalls 38 extending upwardly from the bottom surface, and an end wall 40 adjacent the entry 34. The transfer structure 30 is preferably made of a material that is not susceptible to corrosion, such as stainless steel, galvanized steel, or any other material that is not susceptible to corrosion, as understood by those skilled in the art. The transfer structure 30 is also preferably light in weight. Accordingly, the transfer structure 30 may be made of a lightweight material that is coated with a non-corrosive material.

A plurality of vessel guides 42 may be connected to a top portion of the transfer structure 30, and extend upwardly therefrom. The vessel guides 42 preferably have a length that extends above the water level of the first body of water 17 when the transfer structure 30 is in a lowered, or submerged, position. Accordingly, a user may advantageously visualize the location of the transfer structure 30 when it is submerged in the first body of water 17. The vessel guides 42 may be polyvinyl chloride (PVC) pipe that are cut to a length suitable for extending above the water level of the first body of water 17, or any other material having similar properties so that if the vessel guide comes into contact with the vessel 15, the vessel is not damaged. Although a plurality of vessel guides 42 are shown in the illustrated embodiment, those skilled in the art will appreciate that any number of vessel guides may be provided to allow a user the ability to visualize the location of the transfer structure 30 when submerged in the first body of water 17.

The system 12 further illustratively includes a transfer apparatus 44 adjacent the barrier 20. The transfer structure 30 is connected to the transfer apparatus 44 so that the transfer structure may advantageously be moved between a first position and a second position. The first position is preferably a lowered position, and the second position is preferably an elevated position. More particularly, the lowered position may be a submerged position, i.e., a position in which the transfer structure 30 is submerged in the first body of water 17.

The illustrated embodiment of the transfer apparatus 44 comprises a pair of opposing motors 46, a respective pair of opposing cable engagement rods 48 connected to the respective motors, and a plurality of cables 50 connected between the cable engagement rod and the transfer structure 30. Those skilled in the art will appreciate that the cables 50 may be fixed to the variable engagement members 54. The variable engagement member 54 may be provided by a various radius cam that is fixed to the cable engagement rod 48 to thereby provide a continuous, variable mechanical advantage. Those skilled in the art, however, will appreciate that the variable engagement member 54 may also be provided by any device or apparatus suitable for providing a variable mechanical advantage.

The transfer apparatus 44 also includes a controller 45 for controlling operation of the motors 46. The controller 45 may be in communication with at least one switch (not shown) for activating and deactivating the motors 46. The transfer apparatus 44 also illustratively includes structural members 47 to support the controller 45, the motors 46, the cable engagement rods 48, the variable engagement members 54, and the associated cables 50 for moving the transfer structure 30 between the lowered and elevated positions.

Although the illustrated embodiment of the transfer apparatus 44 shows a pair of opposing motors 46, a respective pair of opposing cable engagement rods 48 connected to the respective motors, and a plurality of cables 50 connected between the cable engagement rods and the transfer structure 30, those skilled in the art will appreciate that the system 12 may also be configured using only one motor, one cable engagement rod, and cables extending between the cable engagement rod and the transfer structure to thereby move the transfer structure between the first and second positions.

Figure 3:
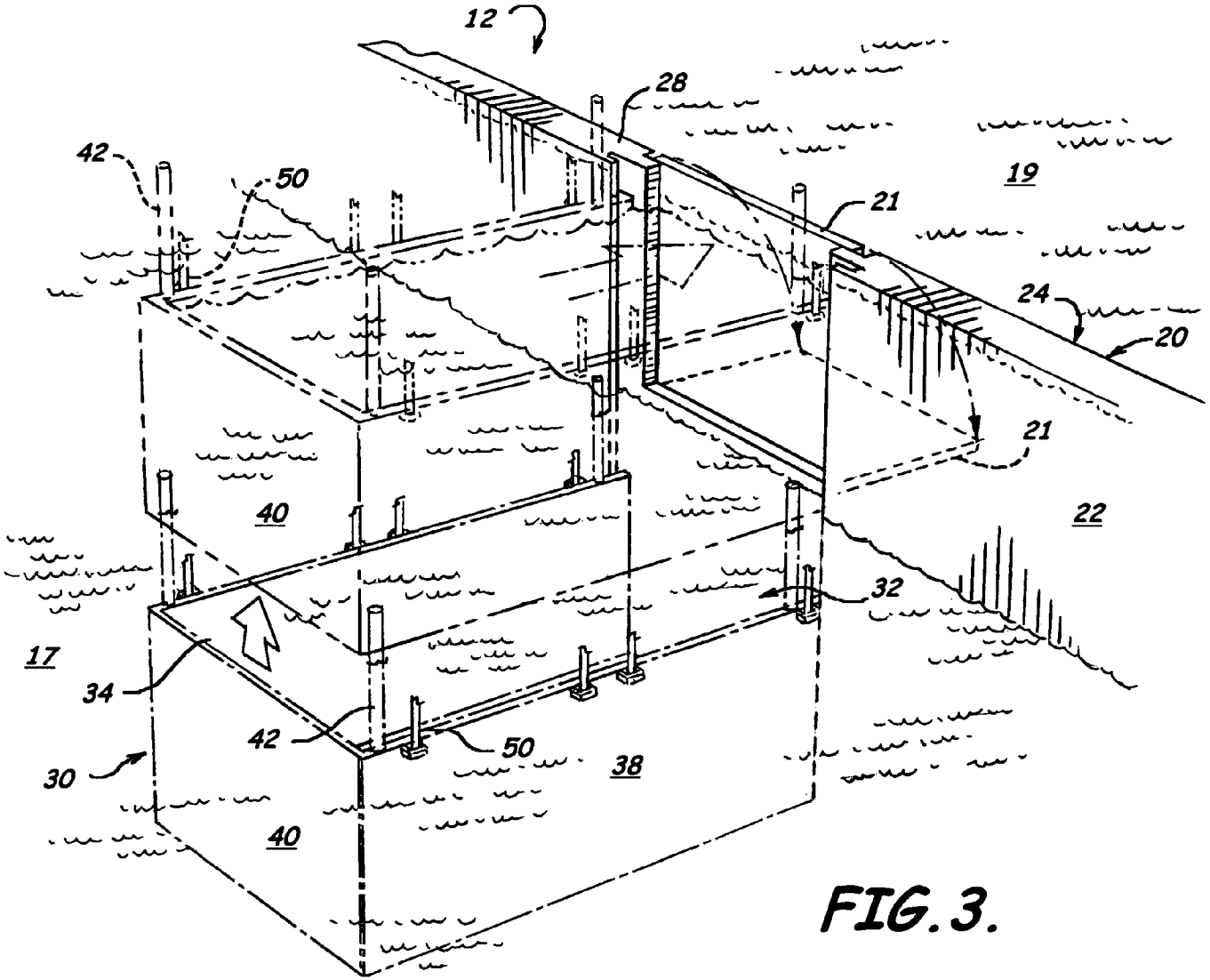
FIG. 3 is a perspective view of the transfer structure illustrated in FIG. 2 being moved between a lowered position and an elevated position.

Referring more specifically to FIG. 3, the upper portion of the barrier 20 illustratively includes a barrier door 21 that is movable between an opened and closed position. More particularly, the barrier door 21 is movable to the opened position when the transfer structure 30 is in the elevated position, and a closed position when the transfer structure is moved from the elevated position to the lowered, or submerged, position so that when the transfer structure is not in the elevated position, the barrier door is closed. When the transfer structure 30 is in the elevated position and the barrier door 21 is moved to the open position, the vessel 15 may move into and out of the transfer structure.

The barrier door 21 is illustrated in FIG. 3 as a hinged barrier door. More specifically, the barrier door 21 is connected to the upper portion 28 of the barrier 20 using a hinged connection. The hinge is preferably made of a material that is not susceptible to corrosion, such as stainless steel, galvanized steel, or any other type of material that is not susceptible to corrosion, as understood by those skilled in the art. The barrier door 21 is preferably light in weight and may, for example, be coated with a non-corrosive material. Another embodiment of the barrier door 21 is discussed in greater detail below.

The system 12 further includes a counterweight apparatus 52 to continuously balance the weight of the transfer structure 30, thus advantageously decreasing the burden on the motor 46 when moving the transfer structure between the lowered and elevated positions. The counterweight apparatus 52 preferably includes the variable engagement member 54, described above, in communication with the cable engagement rod 48, a weight 56, and a length of cable 58 connected between the weight and the variable engagement member. Those skilled in the art will appreciate that the cable 58 may extend from the transfer structure 30 and connect to the variable engagement member 54 on cable engagement rod 48, if so desired. In the illustrated embodiment, the weight 56 of the counterweight apparatus 52 is shown on opposing sides of the transfer structure 30, but those skilled in the art will appreciate that the weight may also be positioned on one side of the transfer structure while still accomplishing the objects, features, and advantages of the present invention.

As described above, the variable engagement member 54 may be a various radius cam connected to the cable engagement rod 48, which may be a rotating shaft, for example, to thereby provide a variable mechanical advantage between the transfer structure 30 and the weight 56 of the counterweight apparatus 52. More specifically, the cable 58 may pass over the variable engagement member 54. Those skilled in the art will appreciate that any other device suitable for providing a variable mechanical advantage when moving the transfer structure 30 between the lowered position and the elevated position may also be provided as the variable engagement member 54.

More specifically, the variable engagement member 54 may be a wheel, or cam, having a variable predetermined radius. The variable radius of the wheel, or cam, determines the amount of the mechanical advantage. Further, the variable engagement member 54 advantageously changes forces associated with moving the transfer structure 30 between the lowered and elevated positions to compensate for variations in weight of the transfer structure as it is raised from the water.

The system 12 may also include a plurality of pulleys (not shown) to change the direction of the cables 50 to configure the system so that it is more suited for a particular site. Those skilled in the art will appreciate that the system 12 may be provided without pulleys, or any number of pulleys that may be necessary. Other pulleys may be provided to increase the mechanical advantage when moving the transfer structure 30 between the lowered and elevated positions. Those skilled in the art will also appreciate that at least one pulley may be included in the system 12 to provide a continuous cable 50 between the weight 56 of the counterweight apparatus 52 and the transfer structure 30.

The weights 56 of the counterweight apparatus 52 may be concrete weights, or any other type of material suitable for providing a weight to counter the weight of the transfer structure 30 when being moved from the lowered position to the elevated position. Four weights 56 may be arranged adjacent opposite sides of the transfer structure 30, i.e., two on each side, are provided in the illustrated embodiment. Those skilled in the art will appreciate, however, that any number of weights 56 of the counterweight apparatus 52 may be provided to counter the weight of the transfer structure 30 when being moved between the lowered position and elevated position.

Figure 4A:
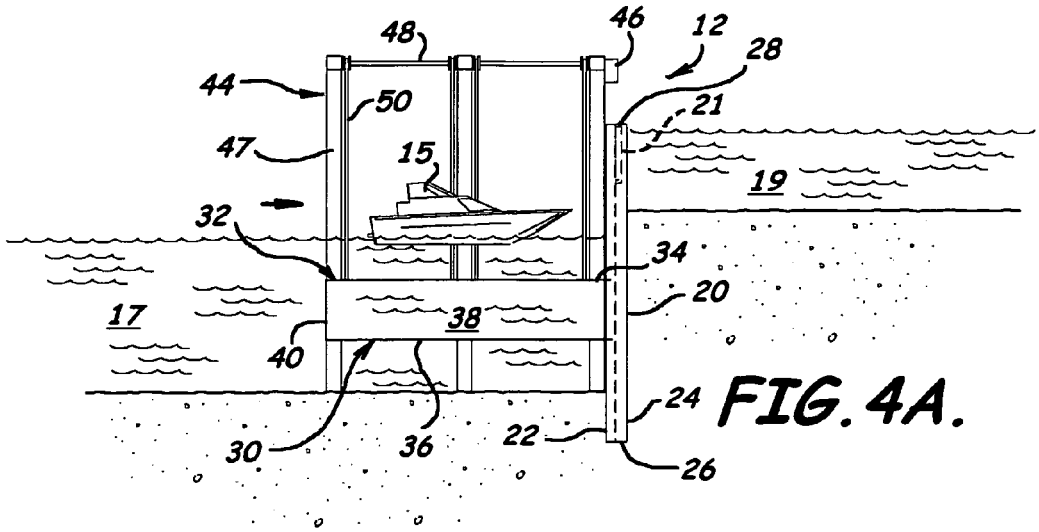
FIGS. 4A–4C are side elevational views of a vessel being transferred from a first body of water to a second body of water using the system illustrated in FIG. 1.
Figure 4B:
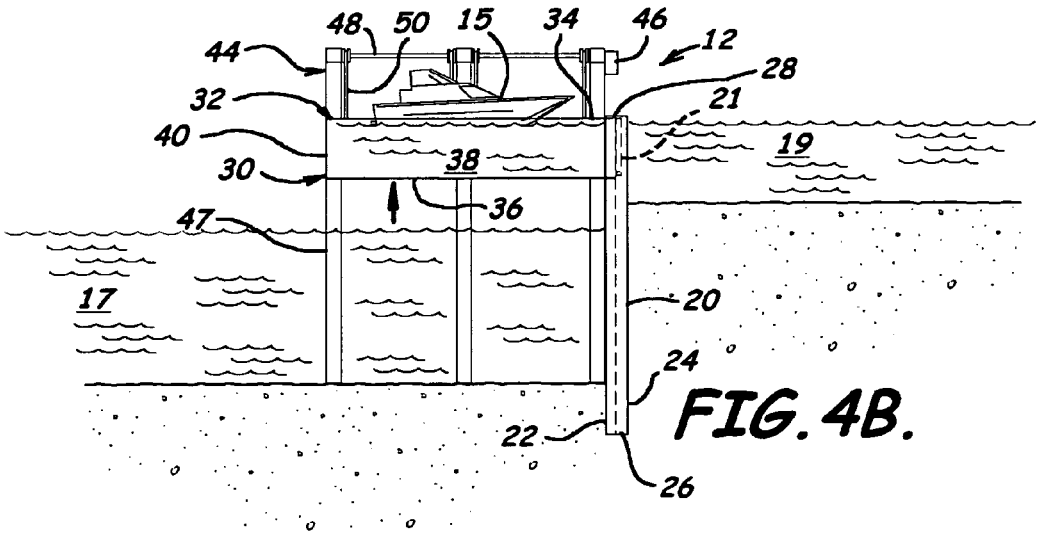
Figure 4C:
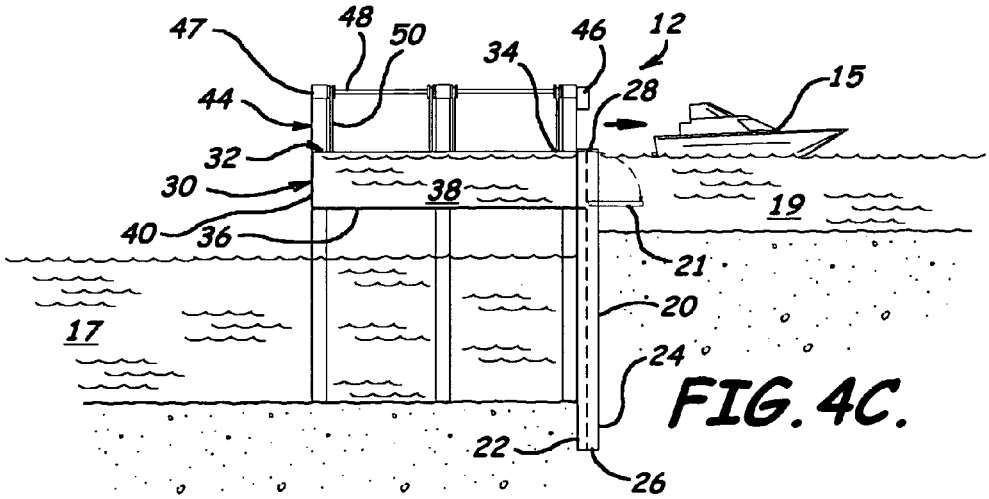

The system 12 of the present invention advantageously allows a vessel 15 to be transferred from a first body of water 17 having a first water level to a second body of water 19 having a second water level without being removed from the water. In other words, and as best illustrated in FIGS. 4A–4C, the system 12 of the present invention advantageously eliminates the need to lift a vessel 15 out of the water in order to transfer it between a first body of water 17 and second body of water 19.

This system 12 also advantageously allows vessels of different sizes, shapes, and weights to be transferred between the first and second bodies of water 17,19. The greater weight associated with a larger vessel 15 would normally restrict the use of a conventional vessel lift that lifts the vessel out of the water. The system 12 of the present invention, however, advantageously uses displacement of water to allow larger vessels 15 to be transferred between the first and second bodies of water 17,19. In other words, the weight of the transfer structure 30 remains constant throughout the process of positioning the vessel 15 to overlie the transfer structure (FIG. 4A), and moving the transfer structure between the lowered and elevated positions (FIG. 4B). Of course, when the vessel 15 is moved from the transfer structure 30 to the second body of water 19 (FIG. 4C), the total weight of the transfer structure remains constant as the displaced water is simultaneously replaced with water from the second body of water 19 when the barrier door 21 is opened and the vessel moves to the second body of water.

Figure 5:
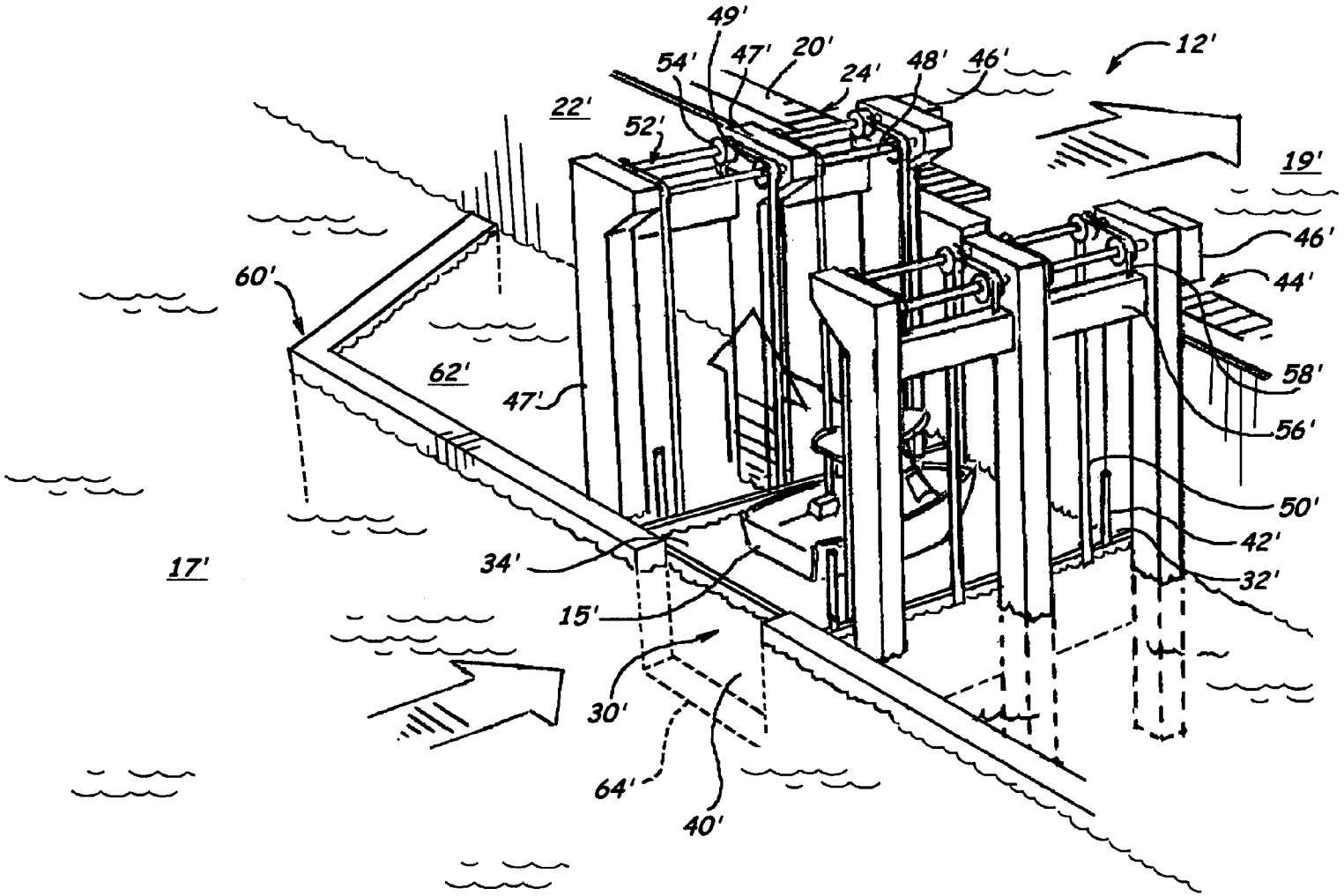
FIG. 5 is a partial environmental view of another embodiment of a system for transferring a vessel between a first body of water and a second body of water and including an additional barrier separating the transfer structure from the first body of water according to the present invention.

Referring now more specifically to FIG. 5, an alternate embodiment of the system 12' is now described in greater detail. In this embodiment, the system 12' illustratively includes an additional barrier 60' separating a body of the water 62' surrounding the transfer apparatus 44' from the first body of water 17'. The level of the water 62' within the additional barrier 60' may advantageously be controlled using pumps, or other machinery (not shown).

The additional barrier 60' may also be particularly advantageous for maintenance purposes. More specifically, the water level of the body of water 62' within the additional barrier 60' may be lowered so that maintenance may be performed on the transfer structure 30' and transfer apparatus 44', if so desired.

The additional barrier 60' may include a barrier door 64' that is moveable between an opened and a closed position. More specifically, an opening in the additional barrier 60' may form the barrier door 64'. The end wall 40' of the transfer structure 30' may act to open and close the barrier door 64' on the additional barrier 60' when the transfer structure is moved between lowered and elevated positions.

Those skilled in the art will also appreciate that the area between the additional barrier 60' and the barrier 20' may be a dry area. This may be accomplished by providing a sliding barrier door (not shown) along a bottom portion of the transfer structure 30' having a depth suitable to provide a seal at the additional barrier door 64' when the transfer structure is in the elevated position. Accordingly, the transfer structure 30' may be moved between the lowered and elevated positions without water from the first body of water 17' entering the dry area.

The arrangement of this embodiment of the system 12' may, for example, be referred to as a guillotine type system. More specifically, when the water level within the transfer structure 30' is at the same level of the first body of water 17', the transfer structure door along the end wall 40' of the transfer structure may be opened. When the water level in transfer structure 30' is above the water level of the first body of water 17', the door along the end wall 40' is held closed. The other elements of this embodiment of the system 12' are similar to those of the first embodiment, are labeled labelled using prime notation, and require no further discussion herein.

Figure 6:
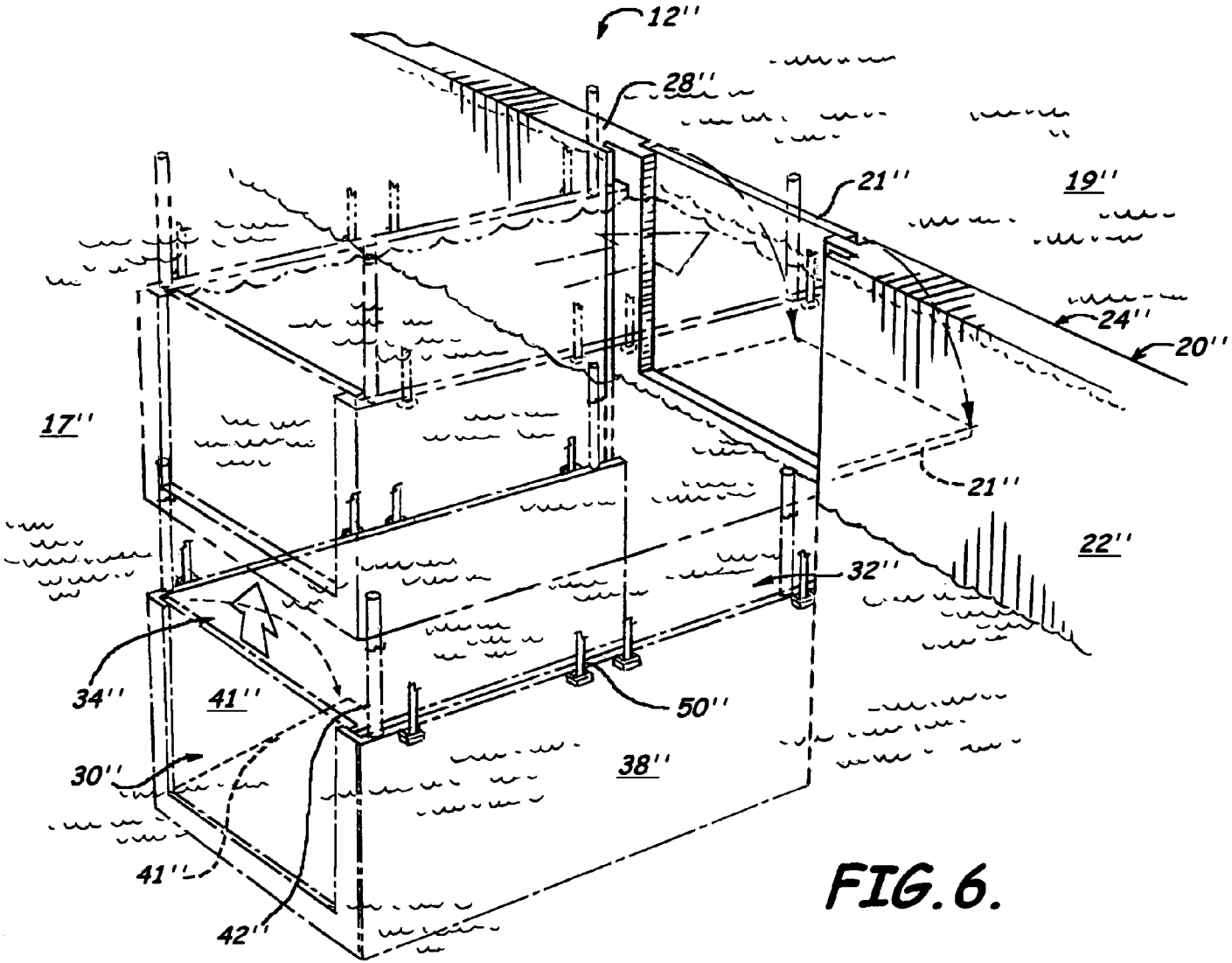
FIG. 6 is a perspective view of still another embodiment of a system for transferring a vessel between a first body of water and a second body of water according to the present invention.
Figure 7A:
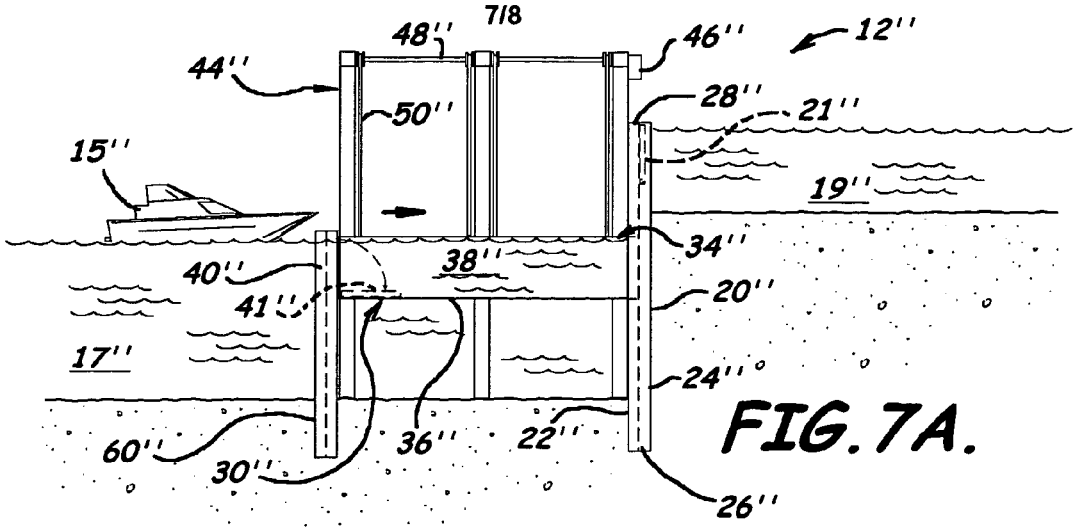
FIGS. 7A–7C are side elevational views of a vessel being transferred from the first body of water to the second body of water using the system illustrated in FIG. 6.
Figure 7B:
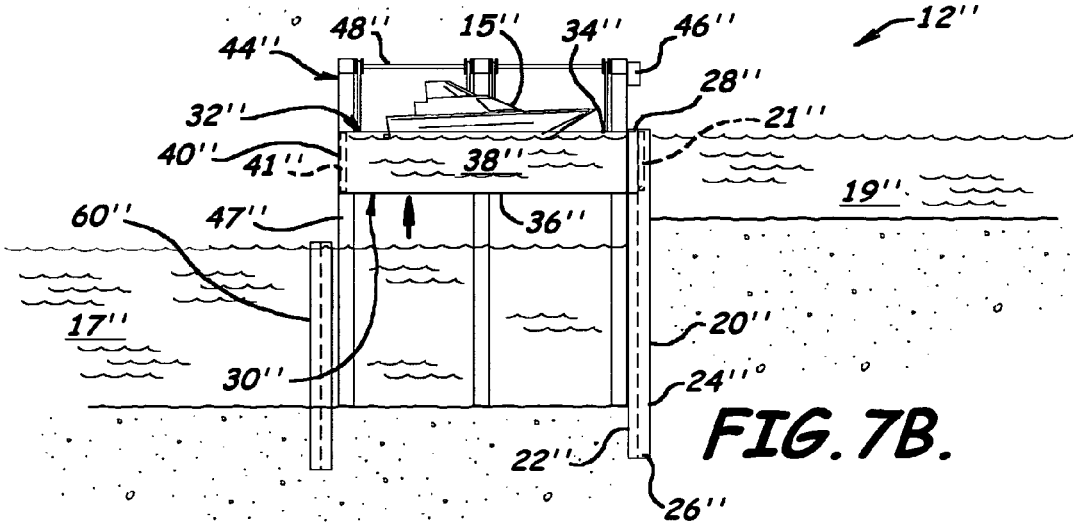
Figure 7C:
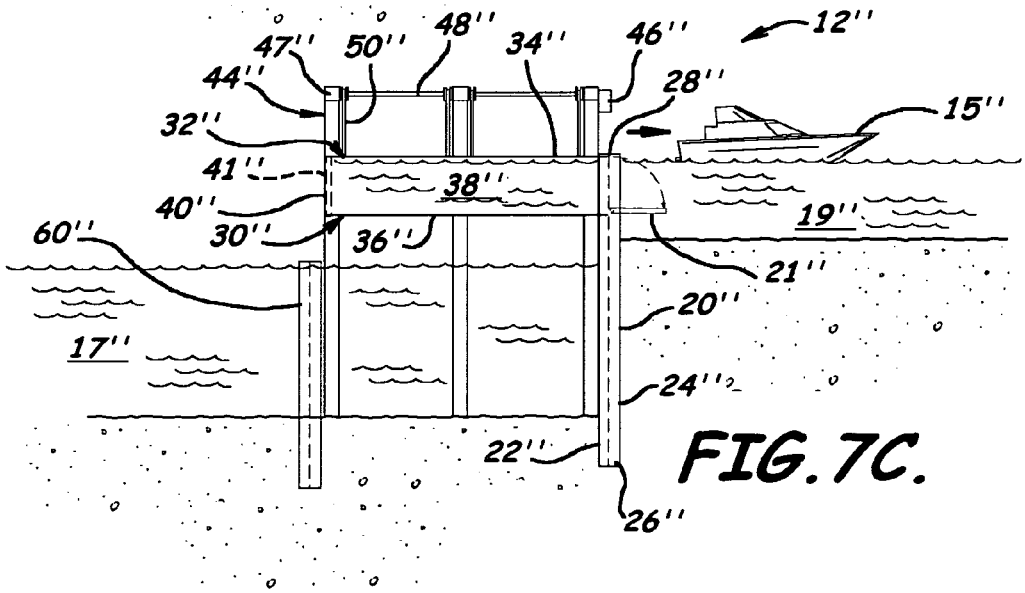

Referring now additionally to FIGS. 6–7C, another embodiment of the system 12" is now described. The embodiment of the system 12" illustrated in FIGS. 6–7C includes a transfer structure 30" having an end wall door 41". More specifically, the end wall door 41" is a hinged end wall door that is movable between an opened position and a closed position.

Those skilled in the art will appreciate that the end wall door 41" may also be a sliding end wall door. More specifically, the end wall door 41" may slide to the right or left or, in some embodiments, may slide downwardly to allow a vessel 15" to be readily positioned to overlie the transfer structure 30".

The end wall door 41" advantageously allows the vessel 15" to be positioned to overlie the transfer structure 30" without the need to lower the transfer structure below the surface of the water. In other words, in order for a vessel 15 to be positioned to overlie the embodiment of the transfer structure 30 illustrated in FIGS. 4A–4C, the transfer structure should be lowered so that the top of the end wall 40 is substantially lower than the water level of the first body of water 17. The embodiment of the transfer structure 30" illustrated in FIGS. 7A–7C, however, only requires that the transfer structure be lowered to a position so that when the end wall door 41" is opened, the top of the end wall 40" (not shown) is approximately even with the water level of the first body of water 17". The other elements of this embodiment of the system 12" are similar to those of the first embodiment, are labelled with double-prime notation, and require no further discussion herein.

Figure 8:
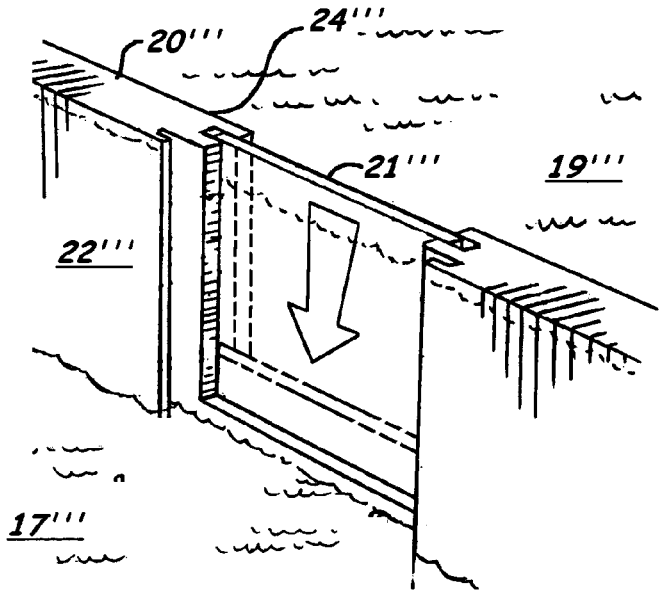
FIG. 8 is a partial perspective view of an alternate embodiment of the barrier door of a system for transferring a vessel between a first body of water and a second body of water according to the present invention.

Referring now additionally to FIG. 8, another embodiment of the barrier 20''' and barrier door 21''' is now described. More specifically, the barrier door 21''' may be a sliding barrier door. In this embodiment the barrier 20'''may be formed with a pocket, or slot (not shown), for receiving the barrier door 21'''. Further, the pocket, or slot, may include rails upon which the sliding barrier door 21'''may slide. Accordingly, when the transfer structure (not shown) is moved to the elevated position, the sliding barrier door 21'''may be moved to the lowered position to allow the vessel (not shown) to exit the transfer structure. The other elements of this embodiment of the barrier 20'''and barrier door 21'''are similar to those of the first embodiment, are labelled with triple-prime notation, and require no further discussion herein.

Figure 9:
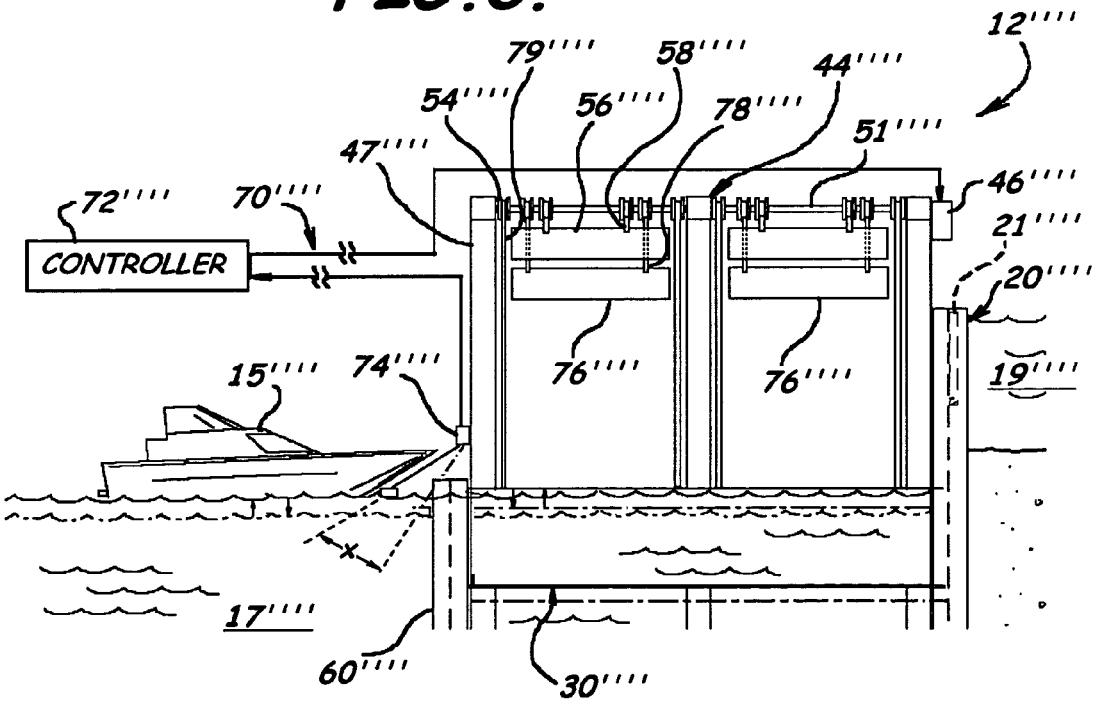
FIG. 9 is a side elevational view of another embodiment of a system for transferring a vessel between a first body of water and a second body of water and including a tide control apparatus according to the present invention.

Referring now additionally to FIG. 9, yet another embodiment of the system 12"" is now described in greater detail. In the embodiment illustrated in FIG. 9, the system 12"" includes a tide control apparatus 70"" for controlling the elevation of the transfer structure 30"" relative to the tide, if applicable. More specifically, in certain areas, the water level of the first body of water 17"" may be affected by the tide. In those areas, it is desirable to have an apparatus to control the level of the transfer structure 30"41 when in the lowered position relative to the tide.

The tide control apparatus 70"41 preferably comprises a controller 72"", a tide control sensor 74"41 in communication with the controller, a tide control weight 76"", and a tide control cable engagement rod 51"". A length of cable 78"41 connects the tide control weight 76"41 to the tide control cable engagement rod 51"". The tide control apparatus 70"41 may also include an additional cable 79"41 extending from the tide control cable engagement rod 51"41 to the transfer structure 30"". The additional cable 79"41 is further connected to the variable engagement member 54"41 on the cable engagement rod 51"41 (not shown).

Those skilled in the art will appreciate that the additional cable 79"41 may pass through at least one pulley between the transfer structure 30"41 and the variable engagement member 54"". Those skilled in the art will also appreciate that a continuous length of cable may pass from the tide control weight 76"41 to the tide control cable engagement rod 51"", and on to the transfer structure 30"", and variable engagement member 54"41 on the cable engagement rod 48"41 (not shown). Those skilled in the art will also appreciate that the tide control weight 76"41 may be connected directly to the transfer structure 30"41 via pulleys. In such a configuration, the continuous length of cable is preferably clamped before the tide control weight 76"41 is engaged, and the tide control weight is preferably positioned with a hydraulic mechanism. Accordingly, the tide control apparatus 70"41 may be operable without the use of a tide control cable engagement rod 51"".

At least one pulley may be positioned between the transfer structure 30"41 and the tide control weights 76"". Further, the tide control apparatus 70"41 further includes a tide control motor 46"41 to assist in adjusting the level of the transfer structure 30"41 depending upon the tide.

The tide control sensor 74"41 may be a sensor mounted on the transfer apparatus 44"41 to monitor the water level of the first body of water 17"". The tide control sensor 74"41 may be in communication with the controller 72"41 via a hard-wired connection, for example, or a wireless connection. More specifically, the wireless connection may be a radio frequency (RF) transmitter in communication with the tide control sensor 74"", and an RF receiver in communication with the controller 72"41 for receiving an RF signal transmitted by the RF transmitter. Those skilled in the art will appreciate that the wireless connection may also be an infrared connection, or any other type of wireless connection.

The illustrated embodiment of the system 12"41 includes a plurality of tide control weights 76"41 positioned adjacent the weights 56"". Those skilled in the art, however, will appreciate that any number of tide control weights 76"41 may be used in the system 12"". The other elements of this embodiment of the system 12"41 are similar to those of the first embodiment, are labelled with multiple prime notation, and require no further discussion herein.

A method aspect of the present invention is for transferring a vessel 15 between the first body of water 17 and the second body of water 19. The method includes submerging the transfer structure 30 in the first body of water 17 adjacent the barrier 20 and positioning the vessel 15 to overlie the transfer structure. The method may also include moving the transfer structure 30 from the first, or submerged, position to the second, or elevated, position and moving the barrier door 21 from the closed position to the opened position when the transfer structure is in the second position to allow the vessel 15 to move out of the transfer structure and into the second body of water 19.

Another method aspect of the present invention is for transferring the vessel 15 from the second body of water 19 to the first body of water 17. The method may include moving the barrier door 21 from the closed position to the opened position when the transfer structure 30 is in the second, or elevated, position to allow the vessel 15 to move into the transfer structure. The method may also include closing the barrier door 21 when the transfer structure 30 is moved from the second, or elevated, position to the first, or submerged, position, and moving the vessel 15 out of the transfer structure adjacent the first body of water 17 when the transfer structure has been moved to the first, or submerged, position within the first body of water.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A system for transferring a vessel between a first body of water having a first water level and a second body of water having a second water level, the system comprising:

a barrier separating the first body of water from the second body of water and having a first side adjacent the first body of water, a second side adjacent the second body of water, a lower portion, and an upper portion;

a transfer structure adjacent the first side of said barrier for receiving the vessel to be transferred between the first and second bodies of water; and at least one transfer apparatus adjacent said barrier for moving said transfer structure between a first position and a second position, said at least one transfer apparatus comprising at least one motor, at least one cable engagement rod connected to said at least one motor, and at least one cable connected between said at least one cable engagement rod and said transfer structure, the upper portion of said barrier including at least one barrier door being movable between an opened position when said transfer structure is in the second position to thereby allow the vessel to move into and out of said transfer structure, and a closed position when said transfer structure is in the first position;

the vessel being transferred between the first and second bodies of water without being removed from water.

2. A system according to claim 1 wherein said at least one barrier door is a hinged barrier door.

3. A system according to claim 1 wherein said at least one barrier door is a sliding barrier door.

4. A system according to claim 1 further comprising a counterweight apparatus.

5. A system according to claim 4 wherein said counterweight apparatus comprises at least one variable engagement member in communication with said cable engagement rod, at least one weight, and a length of cable connected between said at least one weight, said variable engagement member, and said cable engagement rod.

6. A system according to claim 1 further comprising a tide control apparatus for controlling level of said transfer structure relative to a tide.

7. A system according to claim 6 wherein said tide control apparatus comprises:

a controller;

at least one tide control sensor in communication with said controller;

at least one tide control weight;

a tide control cable engagement rod; and a length of cable connecting said at least one tide control weight to said tide control cable engagement rod.

8. A system according to claim 1 wherein said transfer structure has an exit adjacent said barrier, and an entry opposite the exit; and further comprising a bottom surface, a pair of opposing sidewalls extending upwardly from the bottom surface, and an end wall adjacent the entry.

9. A system according to claim 8 wherein the end wall comprises at least one end wall door that is moveable between an opened position and a closed position.

10. A system according to claim 9 wherein said at least one end wall door is a hinged end wall door.

11. A system according to claim 9 wherein said at least one end wall door is a sliding end wall door.

12. A system according to claim 1 wherein the first position is a lowered position, and the second position is an elevated position.

13. A system according to claim 1 wherein the first water level is lower than the second water level.

14. A system according to claim 1 further comprising at least one vessel guide extending upwardly from said transfer structure.

15. A system for transferring a vessel through a barrier in a body of water separating a first body of water having a first water level from a second body of water having a second water level, the barrier comprising a barrier door being movable between an opened position and a closed position, the system comprising:

a transfer structure adjacent the barrier for receiving the vessel to be transferred between the first and second bodies of water; and at least one transfer apparatus adjacent the barrier for moving said transfer structure between a first position and a second position, and comprising at least one motor and at least one cable engagement rod connected to said at least one motor;

said at least one transfer apparatus cooperating with the barrier door so that the barrier door is in the opened position when said transfer structure is in the second position, and in the closed position when said transfer structure is in the first position.

16. A system according to claim 15 where said at least one transfer apparatus further comprises at least one cable connected between said at least one cable engagement rod and said transfer structure.

17. A system according to claim 15 further comprising a counterweight apparatus.

18. A system according to claim 17 wherein said counterweight apparatus comprises at least one variable engagement member in communication with said at least one cable engagement rod, at least one weight, and a length of cable connected between said at least one weight, said variable engagement member, and said cable engagement rod.

19. A system according to claim 15 further comprising a tide control apparatus for controlling level of said transfer structure relative to a tide.

20. A system according to claim 19 wherein said tide control apparatus comprises:

a controller;

at least one tide control sensor in communication with said controller;

at least one tide control weight;

a tide control cable engagement rod; and a length of cable connecting said at least one tide control weight to said tide control cable engagement rod.

21. A system according to claim 15 wherein transfer structure has an exit adjacent said barrier, and an entry opposite the exit; and further comprising a bottom surface, a pair of opposing sidewalls extending upwardly from the bottom surface, and an end wall adjacent the entry.

22. A system according to claim 21 wherein the end wall comprises at least one end wall door that is moveable between an opened position and a closed position.

23. A system according to claim 15 further comprising at least one vessel guide extending upwardly from said transfer structure.

24. A method for transferring a vessel between a first body of water having a first water level to a second body of water having a second water level, the first and second bodies of water being separated by a barrier, the method comprising:

submerging a transfer structure in the first body of water adjacent the barrier;

positioning the vessel to overlie the submerged transfer structure;

moving the submerged transfer structure to an elevated position using a transfer apparatus to move the transfer structure, the transfer apparatus comprising at least one motor and at least one cable engagement rod connected to the at least one motor; and moving a barrier door on an upper portion of the barrier from a closed position to an opened position when the transfer structure is in the elevated position to allow the vessel to move into the second body of water.

25. A method according to claim 24 wherein the transfer apparatus further comprises at least one cable connected between the at least one cable engagement rod and the transfer structure.

26. A method according to claim 25 further comprising counter-weighting the transfer structure using a counter-weight apparatus.

27. A method according to claim 26 wherein the counterweight apparatus comprises a variable engagement member in communication with the cable engagement rod, at least one weight, and a length of cable connected between the at least one weight, the variable engagement member, and the cable engagement rod.

28. A method for transferring a vessel between a second body of water having a second water level to a first body of water having a first water level, the first and second bodies of water being separated by a barrier having a first side adjacent the first body of water, and a second side adjacent the second body of water, the method comprising:

moving a barrier door on an upper portion of the barrier from a closed position to an opened position when a transfer structure adjacent the first side of the barrier is in an elevated position to allow the vessel to move to a position overlying the transfer structure;

moving the transfer structure using a transfer apparatus comprising at least one motor and at least one cable engagement rod connected to the at least one motor;

closing the barrier door when the transfer structure is moved from the elevated position to a submerged position; and moving the vessel out of the transfer structure and into the first body of water after the transfer structure has been moved to the submerged position.

29. A method according to claim 28 wherein the transfer apparatus further comprises at least one motor, and at least one lifting cable connected between the at least one cable engagement rod and the transfer structure.

30. A method according to claim 29 further comprising counter-weighting the transfer structure using a counter-weight apparatus.

31. A method according to claim 30 wherein the counterweight apparatus comprises a variable engagement member in communication with the cable engagement rod, at least one weight, and a length of cable connected between the at least one weight, the variable engagement member, and the cable engagement rod.

* * * * *